United States Patent [19]

Moore

[11] 4,116,187

[45] Sep. 26, 1978

[54] APPARATUS FOR INCREASING THE BLEND AND CHARGE OF THE FUEL-AIR MIXTURE FOR AN ENGINE

[76] Inventor: Randall J. Moore, 916 Engleman Pl., Loveland, Colo. 80537

[21] Appl. No.: 828,263

[22] Filed: Aug. 29, 1977

[51] Int. Cl.[2] ..... F02M 29/06

[52] U.S. Cl. ..... 123/141; 261/84; 48/180 S

[58] Field of Search ..... 123/141, 119 C, 64; 261/84; 48/180 R, 180 S

[56] References Cited

U.S. PATENT DOCUMENTS

| | | | |
|---|---|---|---|
| 1,156,716 | 10/1915 | Shores | 123/141 |
| 1,625,281 | 4/1927 | Ragué et al. | 123/141 X |
| 1,979,747 | 11/1934 | Kenneweg | 48/180 S |
| 2,018,561 | 10/1935 | Lucich | 48/180 S |
| 2,116,962 | 5/1938 | Charzier et al. | 261/84 X |
| 2,186,829 | 1/1940 | Haddock | 261/84 X |
| 2,319,752 | 5/1943 | Smith et al. | 261/84 X |
| 3,283,482 | 11/1966 | Trafford et al. | 123/141 X |
| 3,847,128 | 11/1974 | Pali et al. | 123/141 |

FOREIGN PATENT DOCUMENTS

| | | | |
|---|---|---|---|
| 969,826 | 6/1975 | Canada | 123/141 |

*Primary Examiner*—Ira S. Lazarus
*Attorney, Agent, or Firm*—Hugh H. Drake

[57] ABSTRACT

Apparatus for improving the mixing or blending of the charge of fuel and air to an internal combustion engine and for increasing the quantity of the fuel-air charge to the engine. A rotor member, having a sealing blade and at least one blade member which is angled with respect to a radial reference through the axis of the rotor, is rotated in a housing to draw a portion of the fuel-air charge from a carburetor, to increase the quantity of that portion, to create turbulence in the flow of the fuel-air mixture and to more thoroughly blend the fuel with the air before the mixture is delivered to the cylinder intake of an internal combustion engine.

17 Claims, 8 Drawing Figures

Fig-1
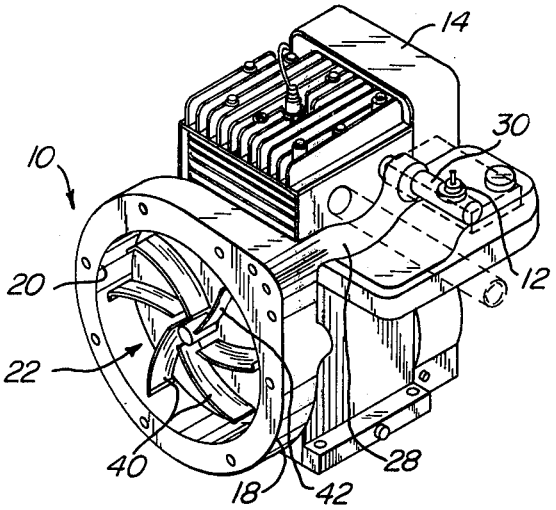
Fig-2
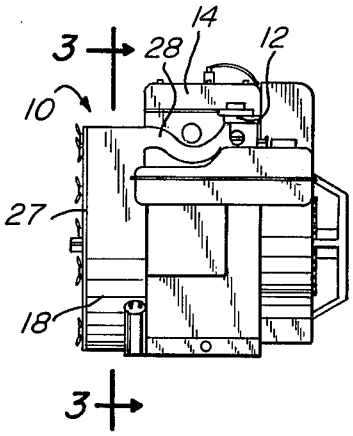
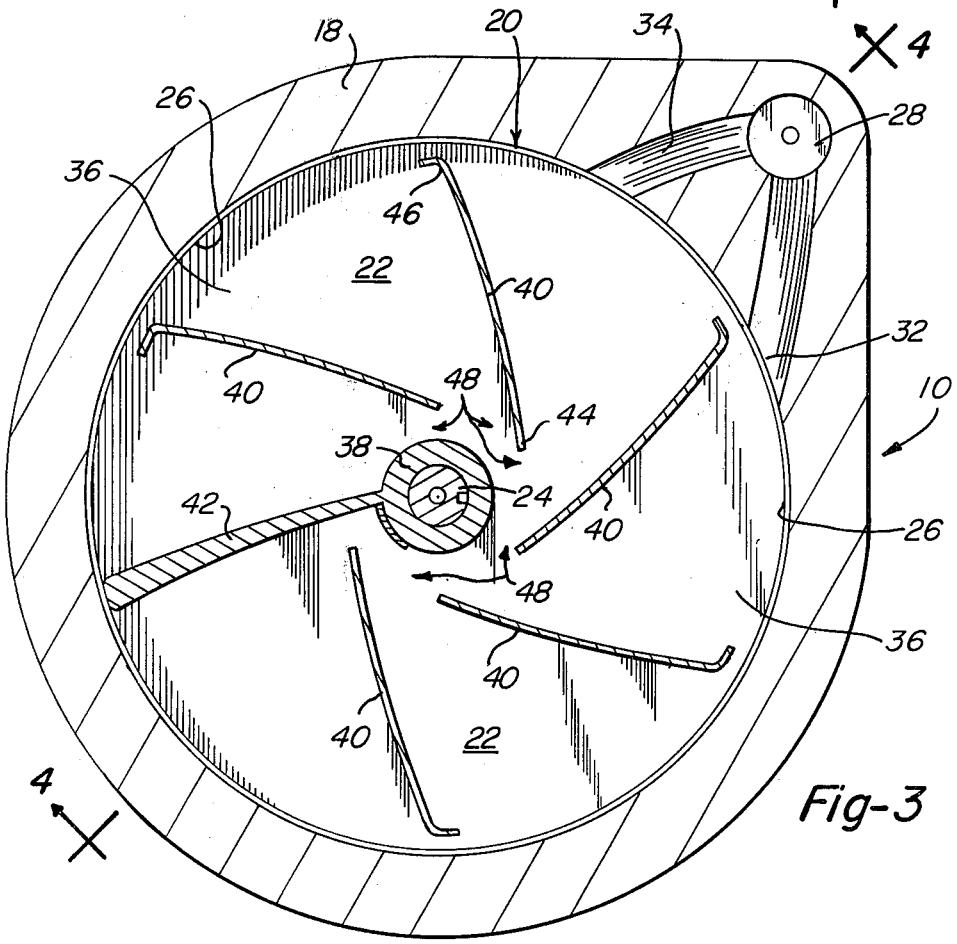
Fig-3

APPARATUS FOR INCREASING THE BLEND AND CHARGE OF THE FUEL-AIR MIXTURE FOR AN ENGINE

BACKGROUND OF THE INVENTION

1. Field of the Invention

This invention relates generally to internal combustion engines, and more particularly to apparatus for more thoroughly blending the fuel air mixture and for increasing the quantity of the charge of the fuel air mixture delivered to the engine.

2. Brief Description of the Prior Art

The conventional fuel delivery mechanism for an internal combusion engine utilizes a carburetor to meter a predetermined quantity of fuel with a predetermined quantity of air flow under widely varying engine operating conditions. In essence, the fuel is mixed with the air in the carburetor by suspending a fine mist of liquid fuel droplets in the airstream created by the intake cycle of each engine piston. This type of fuel-air mixture, generally referred to as an atomized mixture, is then burned in the engine combustion chamber to drive the engine.

It is well recognized that the most desirable type of fuel air mixture is a total vapor rather than an atomized mixture. A totally vaporized fuel air mixture is typically more combustible or explosive than the atomized fuel mixture, and results in better economy of fuel consumptiveness, less pollutant emissions and higher engine power output.

While the recognized objective in fuel delivery apparatus is to obtain the totally vaporized fuel air mixture, it is also a recognized fact that the typical carburetor cannot supply a totally vaporized fuel air mixture. Much research has been directed toward improving the conventional carburetor with the objective of obtaining a fuel-air mixture more on the order of a totally vaporized mixture, that is, a fuel air mixture which is more thoroughly blended or atomized by increasing the number of individual fuel droplets in the air stream and decreasing the size of the droplets. This research has only been partially effective in securing its desired objectives of improving the operating characteristics from a carbureted internal combustion engine.

In general, these problems and the partially successful attempts to remedy these and other known problems in fuel delivery mechanisms for internal combustion engines have pointed out the desirability of obtaining a more completely blended or finely atomized fuel air mixture. It is to this objective and others that the present invention is addressed.

SUMMARY OF THE INVENTION

In accordance with the general objective of this invention, there is provided an apparatus which more thoroughly blends a fuel-air mixture or more finely atomizes the fuel in a fuel-air mixture for an internal combustion engine. The present invention embodies an apparatus which increases the quantity of the charge of fuel-air mixture delivered to the combustion chamber of an internal combustion engine.

According to the present invention, there is provided an air tight housing member having a hollow interior chamber located within the fuel-air mixture flow path between the carburetor and an intake opening to a cylinder in an internal combustion engine. A rotor member is positioned for rotation within the interior chamber and rotates in synchronized relationship with the rotation of the engine. The rotor member comprises a plurality of vanes or blade members, each of which is positioned to create a partial vacuum for drawing a portion of the atomized fuel air mixture from the carburetor into the chamber of the housing member. The arrangement of the blade members on the rotor member also creates turbulence and movement of the fuel air mixture within the chamber of the housing member to more fully blend the fuel air mixture. The rotor member also comprises a sealing member which rotates in synchronized relationship with the opening and closing of the intake opening to the engine cylinder to periodically block the vacuum created by the blade members and allow conduction of the more fully blended fuel-air mixture from the housing chamber into the cylinder of the engine during its intake cycle.

A preferred embodiment of the invention itself and its operation will best be understood by reference to the following brief description of the drawings and detailed description of the preferred embodiments.

BRIEF DESCRIPTION OF THE DRAWINGS

FIG. 1 is a perspective view of a preferred embodiment of the present invention operatively associated with an internal combustion engine, with a cover member of the apparatus broken away to illustrate internal elements.

FIG. 2 is a side elevational view of FIG. 1.

FIG. 3 is an enlarged section view taken substantially in the plane of line 3—3 of FIG. 2.

DESCRIPTION OF PREFERRED EMBODIMENTS

Structure

Figure 4:
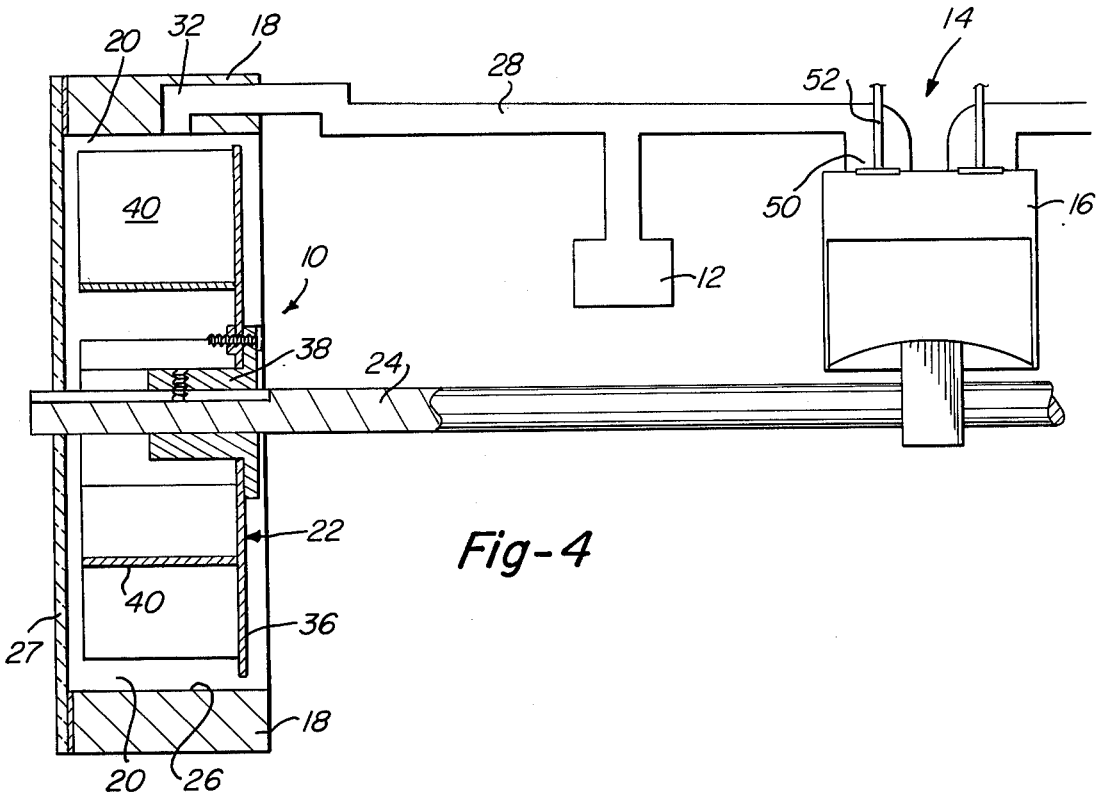
FIG. 4 is a section view of the preferred embodiment of apparatus taken substantially in the plane of line 4—4 of FIG. 3, and also schematically illustrating a portion of the internal combustion engine.

One form of apparatus 10 embodying the present invention is generally shown in FIGS. 1, 2, 3 and 4 positioned for operation in the fuel-air flow path between a conventional carburetor 12 of an internal combustion engine 14 and the cylinder 16 of the engine 14. The apparatus 10 comprises a housing member 18 mounted on the engine casing and defining an interior circular chamber 20. A rotor member 22 is positioned within the chamber 20 and is mounted on the engine shaft 24 to rotate in a direct and synchronized relationship with the engine shaft 24.

The housing member 18 is formed generally as an air-tight enclosure for the purpose of containing fuel and air delivered from the carburetor 12 which is thereafter conducted to the engine 14 for combustion therein.

The chamber 20 of the housing 18 includes a cylindrically shaped sidewall 26 and the chamber is closed by an outer cover member 27. The axis of the cylindrically shaped sidewall 26 is substantially coincident with the axis of rotation of the rotor member 22 as defined by the axis of rotation of the engine shaft 24.

For conducting the fuel-air mixture to and from the apparatus 10, a conduit 28 extends from the engine fuel-air manifold 30 and from the carburetor 12 to a pair of spaced apart ports 32 and 34 opening into the sidewall 26 of the housing member 18. The ports 32 and 34 are positioned in the sidewall 26 and are spaced apart a convenient circumferential distance in accordance with the teachings of the invention as explained and the operating characteristics of the engine.

The rotor member 22 is formed by a circular base plate 36 having a center hub 38 secured to the engine shaft 24. Extending substantially normally from the base plate 36 and in a radially outward manner from the hub 38 are a plurality of vanes or blade members 40 and a wiper or sealing member 42. Each of the blade members 40 is of substantially solid construction, of uniform thickness, and extends from an inner end 44 thereof to an outer end 46 thereof. The outer end 46 of each individual blade member 40 is located more circumferentially advanced in the direction of rotation of the rotor (counter clockwise as shown) than the inner end 44. Each inner end 44 terminates radially short of and in spaced relation from the hub 38. Each inner end 44 is also in spaced relation from the inner ends of adjacent blade members 40 to form gaps 48 between the inner ends of adjacent blade members 40 and the hub 38. The sealing member 42 is of substantially solid construction, of increasing thickness from an inner radial position to an outer radial position, and extends solidly from the hub 38 outward to a position substantially adjacent the cylindrically shaped sidewall 26 of the chamber 20. The unbroken extension of the sealing member 42 from the rotor axis outward to positions substantially adjacent the wall portions of the circular chamber 20 operates essentially similarly to a seal for the purpose of confining a pocket of fuel-air mixture generally in front of the sealing member 42 as it rotates with the rotor 22 within the chamber 20 of the apparatus 10.

Figure 5:
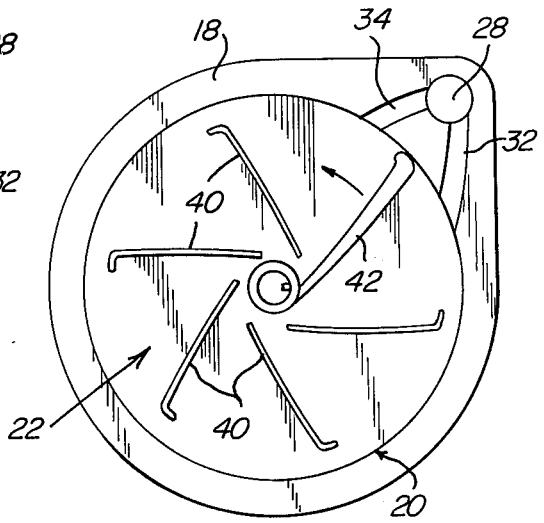
FIG. 5 is a view similar to FIG. 3 illustrating an operative condition during which a more thoroughly blended charge of fuel-air mixture is discharged from the apparatus.

The rotor member 22 is rotated with the engine shaft 24 by directly connecting the base plate 36 to the hub 38 by conventional fastening means, and by conventionally connecting the hub 38 to the engine shaft 24. It is therefore apparent that the rotor member 22 rotates in synchronized relation with the rotation of the engine by this arrangement, but conventional arrangements other than the direct connection may be employed for rotating the rotor member in synchronized relationship with the engine 14. The rotor member 22 is connected to the engine shaft 24 to position the sealing member 42 intermediate the ports 32 and 34 (see FIG. 5) when an intake opening 50 to the engine cylinder 16 is opened as a result of conventional engine operation. In a four cycle engine, the intake opening 50 of each cylinder 16 is opened once every two sequential revolutions by the opening of an intake valve 52 operated by the engine cam shaft, as is known in the art. In a two cycle engine, the intake opening is opened during the downward intake stroke of the engine piston by an arrangement not employing valves, as is also known in the art. Thus, with both two cycle and four cycle engines, there is provided means for periodically opening and closing the cylinder intake opening in timed relationship to the rotation of the engine, and due to the means for rotating the rotor in synchronized relationship with the engine, the sealing member 42 is positioned intermediate the ports 32 and 34 when the intake opening of the engine cylinder is opened.

Figure 7:
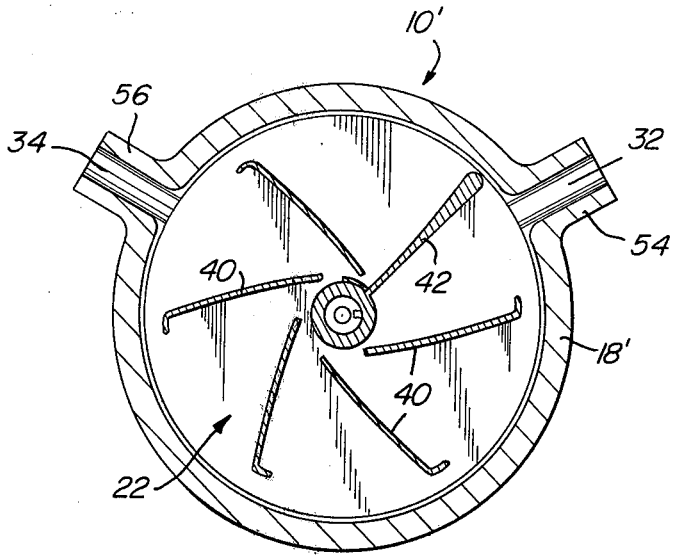
FIG. 7 is a vertical section view of an alternative embodiment of apparatus according to the present invention.
Figure 8:
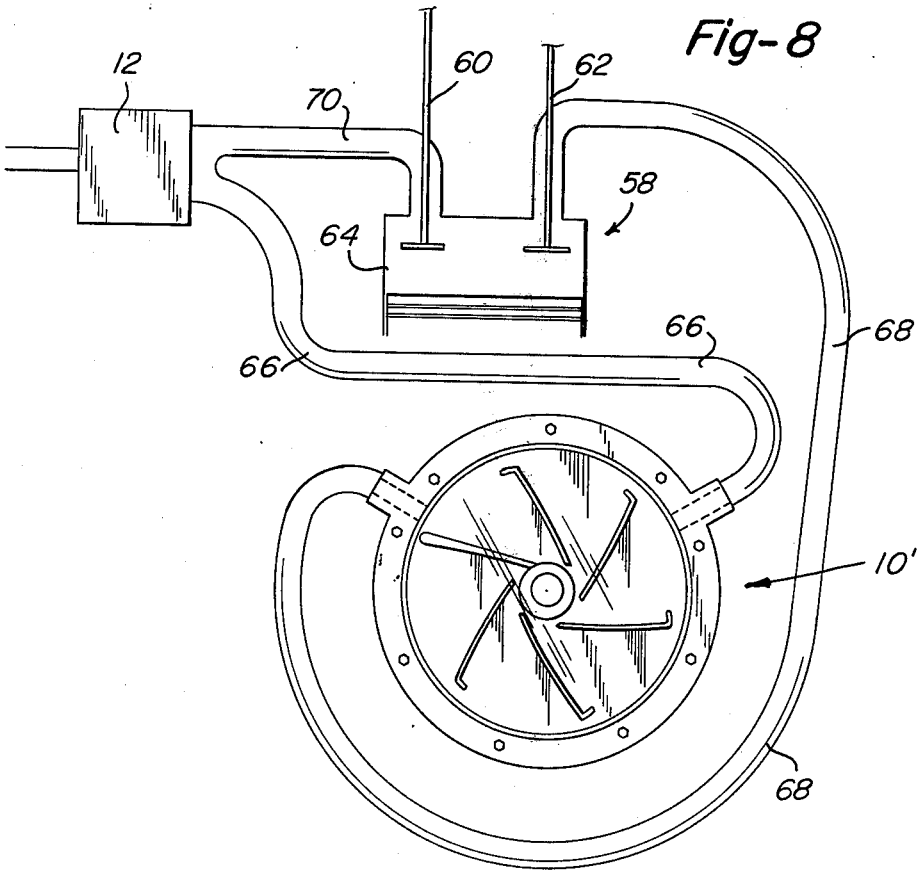
FIG. 8 schematically illustrates use of the apparatus shown in FIG. 7 in conjunction with an internal combustion engine.

Another embodiment of apparatus 10' of the present invention is illustrated in FIGS. 7 and 8. In the apparatus 10' an intake tube 54 is formed in the housing member 18' to define the port 32. An outlet tube 56 is also formed in the housing member and defines the port 34. In all other essential respects, the apparatus 10' is essentially similar to the apparatus 10 previously described.

Operation

As the engine 14 is operated, the rotating rotor member 22 causes a partial vacuum to be created behind at least the outer portions of each blade member 40, which draws a fuel-air charge from the carburetor 12 through the conduit 38 into the chamber 20 of apparatus 10. The angle of each of the blade members 40 in the direction of rotation causes the leading edge thereof to create a flow of the fluid fuel-air mixture toward the gaps 48 between the inner ends of adjacent blade members and the hub 38. The partial vacuum behind the trailing edge of each blade member 40 and the fluid flow toward the gaps induces turbulence within the chamber 20 as the rotor member 22 rotates. The turbulence causes the suspended droplets of fuel within the air to break down or disintegrate and, in general, more finely blend the fuel droplets with the air by reducing the droplets size and increasing the number of individual droplets. Generally, the fuel-air mixture within the apparatus 10 is a more thoroughly blended mixture than a mixture obtained directly from a conventional carburetor.

Figure 6:
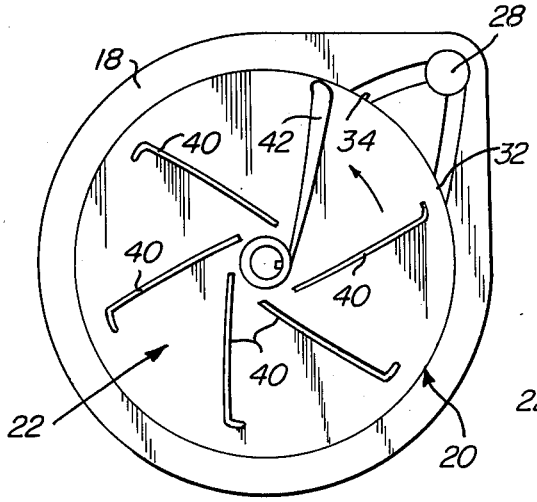
FIG. 6 is a view similar to FIG. 3 illustrating one operative condition during which a fuel-air mixture is drawn into the apparatus.

The fuel-air mixture within the chamber is forced through the gaps 48 by action of the blade members 40, and generally accumulates as a pocket in front of the leading edge of the sealing member 42. Due to the synchronized rotational relationship of the rotor member 22 with the engine, the sealing member 42 is rotated past the opening 32 to a position intermediate the ports 32 and 34 when the intake opening 50 (FIG. 4) to the engine cylinder 16 opens. The pocket of more thoroughly blended fuel-air mixture which has accumulated in front of the sealing member 42 is removed from the apparatus 10 through the port 34 due to the suction created by conventional engine operation during the engine intake cycle or stroke. After the sealing member 42 rotates past the port 34, as is shown in FIG. 6, the blade members 40 continue to draw a fuel-air mixture into the chamber 20 of the apparatus 10, and more thoroughly blend that charge of fuel and air in preparation for allowing the removal of the charge during the next intake cycle or stroke of the engine. The fuel-air mixture is essentially drawn from the carburetor into the chamber 20 until the pocket of more thoroughly blended fuel and air is removed from in front of the sealing member 42 during the next subsequent intake cycle or stroke of the engine.

One apparatus 10 having a single sealing member 42 can be used with each cylinder of a two cycle engine or with each pair of cylinders of a four cycle engine. Since each rotation of a two cycle engine involves one intake stroke, the single sealing member 42 rotating in synchronization with the engine will deliver one charge of more thoroughly blended fuel and air to one cylinder during each rotation of the two-cycle engine. If the two cycle engine consists of more than one piston, one apparatus 10 is used for each piston. Since each two consecutive revolutions of a four cycle engine result in one intake cycle for each cylinder, one apparatus 10 can be directly connected to the intake openings of two cylinders in a four cycle engine whose intake cycles are exactly one revolution apart, so that the rotating sealing member 42 supplies one charge of more thoroughly blended fuel and air to one of the two cylinders during the first of the two revolutions and to the other of the two cylinders during the second of the two revolutions. Since the intake valve of only of the pair of cylinders opens during each revolution, the more thoroughly blended charge of fuel and air is delivered only to the cylinder undergoing an intake cycle. During the next subsequent revolution, the charge of more thoroughly blended fuel and air is delivered to the other cylinder. Of course, one apparatus 10 can be used with a single cylinder-four cycle engine, but the apparatus supplies only one charge to the engine cylinder during each pair of engine revolutions. The number of sealing members can also be increased to achieve the same results in accordance with the teachings of the present invention. In other engine arrangements, suitable gearing or other motive coupling may be employed between rotor member 22 and the engine crankshaft in order to obtain the required synchronism with intake valve openings.

It will be observed that ports 32 and 34 connect commonly to conduit 28. It is within the contemplation of the invention to rely upon use of only a single port for both drawing the air-fuel mixture into chamber 20 and delivering the blended mixture back into the conduit. However, both ports are presently preferred on the basis of observed engine performance, although the reason is not clearly understood.

Operation of the apparatus 10', as is illustrated in FIG. 8, occurs in conjunction with an internal combustion engine 58 having two intake valves 60 and 62 for each of its cylinders 64. A fuel-air charge is drawn from the carburetor 12 into the chamber 20 through a conduit 66 connected to the inlet tube 54. The more thoroughly blended charge of fuel and air is supplied from the outlet tube 56 through a conduit 68 to an intake opening of the cylinder opened and closed by the intake valve 62. A conventional charge of fuel and air is supplied directly from the carburetor 12 through a conduit 70 to a cylinder intake opening which is opened and closed by the intake valve 60. By this arrangement, a conventional charge of fuel and air and a more thoroughly blended charge of fuel and air are both conducted into the engine cylinder 64. The charge supplied by the apparatus 10', which is generally more combustible than the conventional charge, readily explodes and combusts and thereby causes a more complete and efficient combusion of the conventional charge supplied directly by the carburetor 12. Used in this manner with the engine 58, the apparatus 10' generally results in a more efficiently operating engine.

By the present invention, the charge of fuel and air delivered to the cylinder of an engine is more thoroughly blended than the charge of fuel and air supplied directly by a conventional carburetor to the cylinder. The more thoroughly blended charge generally results in better fuel consumption economy, less pollutant emissions and generally more power output from the engine. The charge of fuel and air delivered by the apparatus of the present invention is generally slightly increased in quantity over the charge typically delivered directly from a conventional carburetor. The slight increase in charge results from the partial vacuum of the blade members 40 created during rotation which draws the slightly increased charge into the chamber 20 of the apparatus. In addition, the rotational inertia of the engine is increased by the rotating rotor member 22 connected to the engine. The increased rotational inertia generally results in a smoother running engine, among other advantages, due to the increased flywheel effect from the rotor member.

Although the present invention has been described with a certain degree of particularity, it should be understood that this disclosure has been made by way of preferred example, and that changes in detail of structure may be made without departing from the spirit and scope of the invention as expressed in the appended claims.

I claim as my invention:

1. In an internal combusion engine system having a carburetor for mixing fuel and air, an intake opening to a cylinder of said engine and a manifold for delivering fuel and air from said carburetor to said intake opening, the improvement comprising:

a housing member of an essentially airtight construction and including a hollow interior chamber;

port means defined in said chamber for receiving and delivering fuel-air mixture;

a conduit coupled between said port means and said manifold for communicating fuel-air mixture between said manifold and said port means;

blending means disposed within said chamber for inducing turbulence into air-fuel mixture drawn through said port means from said conduit and delivering blended air-fuel mixture through said port means to said conduit;

and means for driving said blending means in synchronized relationship with operation of said engine, said driving means effecting delivery of said blended air-fuel mixture to said conduit when the intake opening of said engine is opened.

2. Apparatus as defined in claim 1 in which said blending means includes a rotor member positioned for rotation about an axis within the chamber of said housing member, and said rotor member comprises:

at least one blade member, each blade member extending from an inner end thereof to an outer end thereof, each inner end being positioned in spaced relationship from the axis of the rotor and in spaced relationship with respect to the inner ends of each adjacent blade member, whereby gaps are formed between the inner end of each blade member;

at least one sealing member, each sealing member extending from the axis of said rotor to a position substantially adjacent to the housing member whereby the sealing member substantially forms a seal with the chamber of the housing member during rotation of said rotor member;

and said driving means rotates said rotor member in synchronized relationship with rotation of said engine.

3. An apparatus as recited in claim 2 wherein said rotor member comprises a plurality of blade members.

4. Apparatus as recited in claim 3 wherein the outer end of each individual blade member is positioned more circumferentially advanced in the direction of rotation of said rotor than its inner end.

5. Apparatus as recited in claim 4 wherein the chamber of said housing member includes a substantially cylindrically shaped side wall portion.

6. Apparatus as recited in claim 5 wherein said rotor member is positioned for rotation about an axis substantially coincident with the axis of the cylindrically shaped sidewall portion.

7. Apparatus as recited in claim 3 wherein each of said blade members is angled with respect to a radial reference through the axis of said rotor to create a partial vacuum behind portions of each blade member and to create a flow of fluid toward the gap in front of portions of each blade member.

8. An invention as recited in claim 1 further comprising, in combination with said apparatus:

an internal combusion engine including at least one cylinder having an intake opening thereto, and also including means for periodically opening and closing said intake opening in relation to rotation of said engine.

9. An invention as recited in claim 8 wherein said internal combustion engine is selected from the group consisting of two cycle engines and four cycle engines.

10. An invention as recited in claim 8 wherein said internal combusion engine is a four cycle engine, and one of said apparatus is provided for each group of no more than two cylinders of said engine.

11. An invention as recited in claim 8 wherein said internal combustion engine is a two cycle engine, and one of said apparatus is provided for each cylinder of said engine.

12. An invention as recited in claim 1 further comprising, in combination with said apparatus:

an internal combustion engine including at least one cylinder having two intake openings thereto and means for periodically opening and closing said intake openings in relation to rotation of said engine;

a carburetor;

means for connecting said carburetor to supply a fuel air mixture charge directly through one of said intake openings to the cylinder;

means for connecting said carburetor to supply a fuel-air charge to said apparatus; and means for connecting said apparatus to supply the more completely blended fuel air charge through the other of said intake openings to the cylinder.

13. Apparatus for more completely blending a charge of fuel and air delivered from a carburetor and supplied through an intake opening to a cylinder in an internal combusion engine, comprising:

a housing member of an essentially airtight construction including a hollow interior chamber, and a first opening means formed in said housing for communicating between the carburetor and the chamber, and a second opening means formed in said housing for communicating between the chamber and the intake opening of the engine cylinder, the first and second opening means being positioned in spaced relation with respect to one another;

a rotor member positioned for rotation about an axis within the chamber of said housing member, said rotor member comprising:

at least one blade member, each blade member extending from an inner end thereof to an outer end thereof, each inner end being positioned in spaced relationship from the axis of the rotor and in spaced relationship with respect to the inner ends of each adjacent blade member, whereby gaps are formed between the inner end of each blade member, and at least one sealing member, each sealing member extending from the axis of said rotor to a position substantially adjacent the housing member whereby the sealing member substantially forms a seal with the chamber of the housing member during rotation of said rotor member; and means for rotating said rotor member in synchronized relationship with rotation of the engine, said rotating means further positioning the sealing member of said rotor intermediate the first and second opening means of said housing member when the intake opening of the engine cylinder opens.

14. Apparatus as recited in claim 13 wherein the first and second opening means are positioned in a cylindrically shaped sidewall of said chamber.

15. Apparatus as recited in claim 13 wherein:

the chamber of said housing member includes a substantially cylindrically shaped sidewall portion;

said rotor member is positioned for rotation about an axis substantially coincident with the axis of the cylindrically shaped sidewall portion; and the first and second opening means are positioned in the sidewall.

16. Apparatus as recited in claim 15 wherein said rotating means is adapted to rotate the sealing member of said rotor member past the first opening means in the sidewall prior to the time when the intake opening to the engine cylinder opens.

17. Apparatus as defined in claim 13 in which a manifold is coupled between said carburetor and said intake opening for permitting the flow of fuel and air directly from said carburetor to said intake opening, and in which both said first and second opening means are coupled to said manifold for communicating between said chamber and said manifold.

* * * * *